United States Patent [19]

DeSantis

[11] Patent Number: 4,554,847

[45] Date of Patent: Nov. 26, 1985

[54] OPEN END RATCHET WRENCH

[76] Inventor: Ercele A. DeSantis, 1759 Terr. Dr. West, Lake Worth, Fla. 33460

[21] Appl. No.: 585,524

[22] Filed: Mar. 2, 1984

[51] Int. Cl.[4] ..... B25B 13/28

[52] U.S. Cl. ..... 81/111

[58] Field of Search ..... 81/97, 99, 111

[56] References Cited

U.S. PATENT DOCUMENTS

| | | | |
|---|---|---|---|
| 344,379 | 6/1886 | Humphrey | 83/431 |
| 2,009,913 | 7/1935 | Bever | 83/431 |
| 2,103,537 | 12/1937 | Killman | 83/431 |
| 2,279,376 | 4/1942 | Marriott | 83/431 |
| 2,310,416 | 10/1957 | Russell | 83/431 |
| 2,426,191 | 8/1947 | Feiring | 81/111 |
| 2,846,912 | 8/1958 | Day | 81/111 X |
| 3,132,886 | 5/1964 | Meeks | 81/111 X |

FOREIGN PATENT DOCUMENTS

| | | | |
|---|---|---|---|
| 53653 | 4/1923 | Sweden | 81/111 |

*Primary Examiner*—James G. Smith

*Attorney, Agent, or Firm*—Eugene F. Malin

[57] ABSTRACT

Disclosed herein is an open-ended ratchet wrench which can turn a nut in one direction in a conventional manner and which can have the open-ended jaws expanded to allow the wrench to ratchet back around the nut. This is accomplished by providing a lower jaw member pinned to the main body which is held in a normal position by a pawl. When force is placed against the pawl, it rotates to allow the lower jaw member to rotate to an expanded position. Both the lower jaw member and the pawl are biased to the normal position by springs. The lower jaw member is pinned to the main body by a cam inserted into a cutout in the main body.

20 Claims, 3 Drawing Figures

OPEN END RATCHET WRENCH

Open-ended wrenchs are among the most important tools that the mechanic carries. The wrenchs are used for securing nuts to bolts in many applications. The nuts may be shaped square or hexagonal and the open-ended wrench is useful for securing either. The nuts are measured between two parallel sides thereof by a line perpendicular to both sides through the middle. The wrench open end has two parallel faces or jaws adapted to fit easily over the nut. When the wrench is positioned it can be turned in the appropriate direction to either secure the nut against a fixture or to loosen the nut. In many applications, the wrench cannot be turned a full 360° because another object is in the path of the handle. The wrench has to then be removed from the nut and repositioned free from the interferring object.

Ratchet wrenchs are also well known in the art. However, these wrenchs are the box-type which fits over the top of the nut. Typically, the ratchet wrench includes a ratcheting handle and a nut driver which fits over the handle. This creates a unit of substantial width compared with the typical open end wrench. In many instances, it is difficult to get a ratchet wrench over the top of the nut because of lack of space and it is necessary to use the open-ended wrench. In the past, each time it is desired to move the wrench it has to be slipped off the nut and reapplied at a different angle and then turned in appropriate amount. This must be repeated many times where a small angular area exists in which the wrench can be turned.

It would be desirable if an open-ended wrench could be designed which could be moved against the direction of turning to a new position without physically being removed from the nut. Such an open-ended wrench would have all the ease of use of the traditional ratchet-type wrench and the additional ability to fit in the small spaces.

In accordance with the one preferred embodiment of this invention, there is provided an open-end wrench used to secure a nut comprising a main body and a lower jaw member. The main body forms the first jaw and the back of the open end. The lower jaw member is pivotably connected to the main body to pivot between first and second positions respectively displacing said lower jaw from said upper jaw by first and second distances. The first distance allows the wrench to rotate the nut as it is rotated and the second distance allows the wrench to rotate around the nut as it is rotated.

One preferred embodiment of the subject invention is hereafter described with specific reference being made to the following Figures in which.

Figure 1:
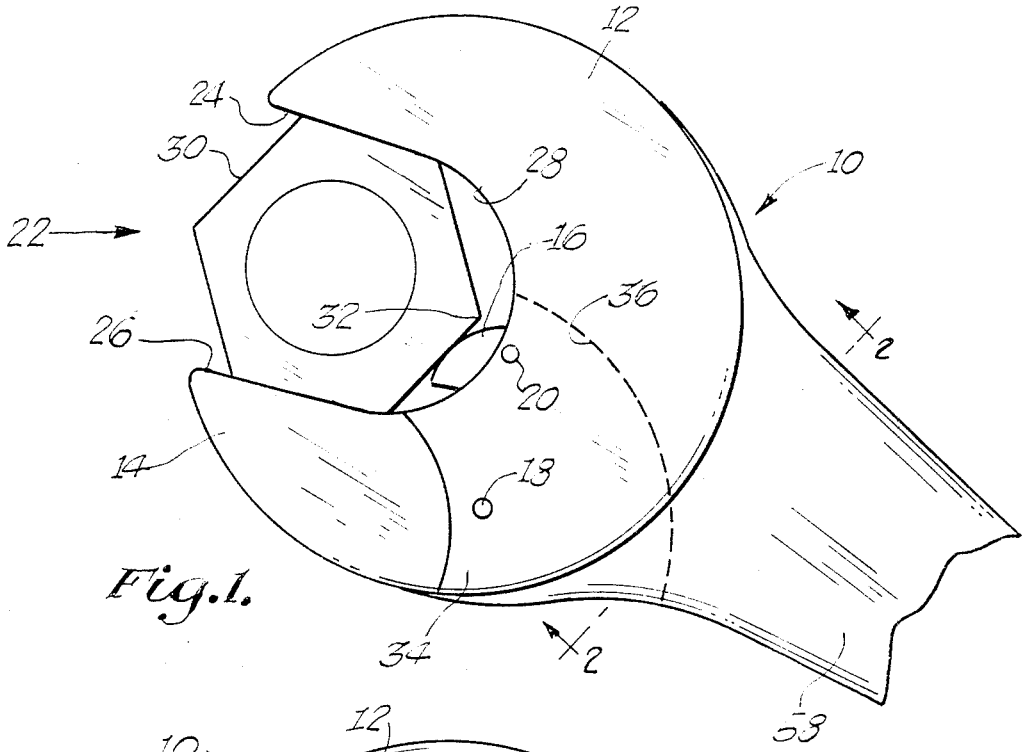
FIG. 1 shows the open-ended ratchet wrench viewed from the top.

Referring now to FIG. 1, the open end ratchet wrench 10 consists of three principle parts, the main body 12, the lower jaw member 14, and the pawl 16. Lower jaw member 14 is connected to body 12 by a pin 18 and pawl 16 is connected to body 12 by a pin 20. Member 14 rotates around pin 18 and pawl 16 rotates around pin 20 in a manner which will be described hereafter.

When member 14 is connected to body 12, open-end 22 is formed. Open-end 22 consists of upper jaw 24, a lower jaw 26 and a back 28. Open-end 22 is sized so that the distance between upper jaw 24 and lower jaw 26 is slightly larger than the size of a nut 30 which may be inserted into open end 22. Back 28 is rounded so that the point 32 of a hexagon nut 30 may fit near back 28.

As will be explained hereafter, when wrench 10 is forced against nut 30, pawl 16 rotates about pin 20, releasing lower jaw 14 so it can rotate around pin 18 in a downward direction. When this occurs the distance between upper jaw 24 and lower jaw 26 increases so that the open end 22 may slip around nut 30. The amount which lower jaw member 14 rotates is based on the distance from one point such as 32 of nut 30 to the diametrically opposite point of nut 30.

Figure 2:
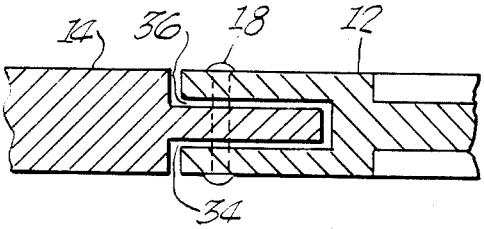
FIG. 2 shows a side view of the open end ratchet wrench taken along line 2—2 shown in FIG. 1.

Referring now to FIG. 2, the manner in which lower jaw member 14 is coupled to main body 12 is illustrated. Lower jaw member 14 has a cam extension 34 extending therefrom. The thickness of the main part of member 14 forming lower jaw 26 is the same thickness as is main body 12. Cam 34, however, is thinner than either lower jaw member 14 or main body 12. A cut is made horizontally through body 12 in the area adjacent to where lower jaw member 14 is to be placed. Cam 34 is placed within cut 36 and held there by pin 18. In this manner, cam 14 rotates around pin 18. Cut 36 should be made sufficiently large so that cam 34 can rotate as member 14 rotates. While not shown in FIG. 2, it should be noted that pawl 16 is also positioned substantially within cut 36.

Figure 3:
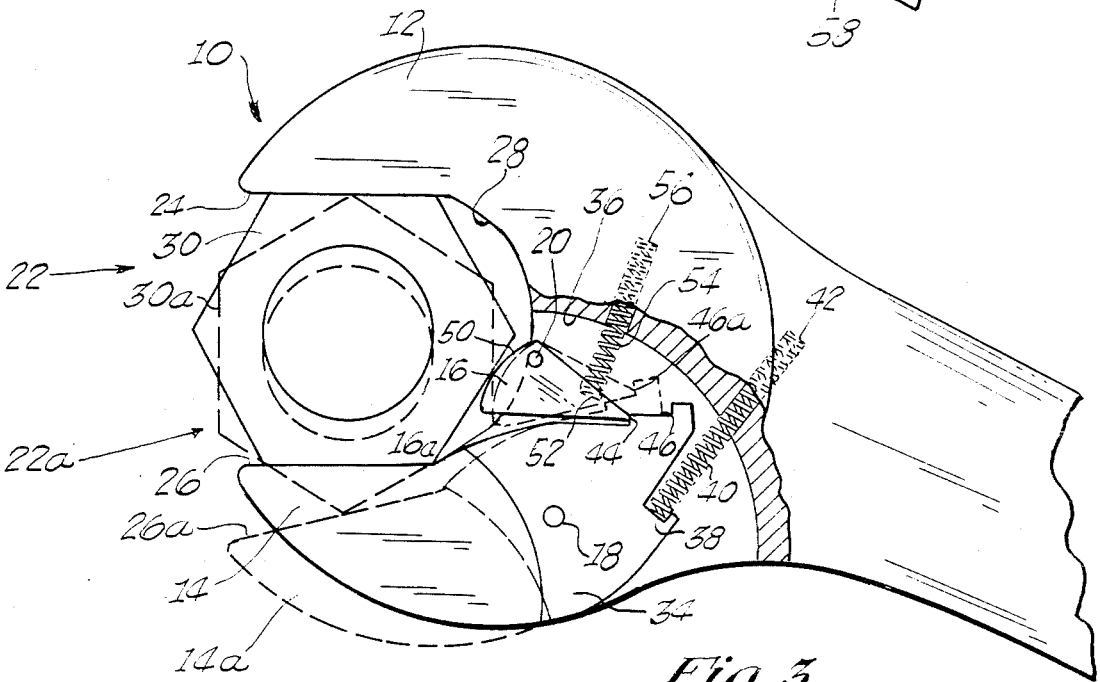
FIG. 3 shows a top view, partially in cutaway showing the various positions of the movable parts of the open end ratchet wrench.

Referring now to FIG. 3, a top cut-away view of wrench 10 is shown with the cut area being shown so that the entire lower jaw member 14 and pawl 16 are shown. In addition, FIG. 3 shows the normal position of member 14 and pawl 16 in solid lines and the rotated positions of member 14, referenced as **14*a*, and the rotated positions of pawl 16, referenced as 16*a***, shown in dashed lines.

Cam extension 34 which extends within cut 36, has an area 38 adapted to receive a spring 40, the other end of which is inserted into a hole 42 drilled into main body 12. In addition, cam 34 includes two teeth 44 and 46. The back end 48 of pawl 16 is normally positioned against tooth 44 to hold lower jaw member 14 into position shown by the solid line. When pressure is applied against front end 50 of pawl 16, pawl 16 rotates about pin 20 to the position shown by the dashed lines shown as **16*a*. In this position, the back end 48 of pawl 16 is above tooth 44 allowing lower jaw member 14 to rotate downward about pin 18 to the position shown in the dashed lines as 14*a*. In this instance, the back 48 of pawl 16 rests against the now raised tooth 46*a* preventing lower jaw 14** from further rotation.

Pawl 16 has an area 52 adapted to receiving spring 54 the other end of which is inserted into hole 56 drilled into main body 12. Spring 54 biases pawl 20 downward so that it will normally attempt to be positioned against tooth 44 as long as lower jaw member 14 is in the normal position shown by the solid line. This usually is the case as a result of the biasing effect of spring 40 on member 14. Pawl 16 should extend beyond back 28 at a position below (towards lower jaw member 14) the position of point 32.

When it is desired to secure a nut in a direction by rotating the handle 58 downward, lower jaw member 14 is in the solid line position and upper jaw 24 and lower jaw 26 are positioned around the opposite flat surfaces of nut 30. Upon reaching a barrier pass which handle 58 cannot move, pressure is applied against nut 30 which forces pawl 16 to rotate about pin 20. This frees cam 34 to rotate about pin 18. As the handle 58 is raised, a greater distance is furnished by nut 30 in open end 22 between jaws 24 and 26 and lower jaw member 14 rotates about pin 18. Tooth 46 should be positioned to allow lower jaw member 14 to rotate a sufficient amount to allow the open end 22 to rotate about nut 30 in the reverse direction.

What is claimed is:

1. An open end wrench used to secure a nut comprising:

a main body integrally forming an upper jaw and a back;

a lower jaw pivotably connected to said main body to pivot between first and second positions respectively displacing said lower jaw from said upper jaw by first and second distances, said lower jaw including a cam having a tooth therein;

said first distance allowing said wrench to rotate said nut as it is rotated and said second distance allowing said wrench to rotate around said nut as said wrench is rotated; and release means for releasing said lower jaw to pivot from said first position to said second position, said release means including a pawl extending from said body to between said jaws, said pawl being pivotally connected to said body to pivot between a first cam position engaging said tooth and a second cam position disengaged from said tooth.

2. The invention according to claim 1 further comprising spring means for biasing said cam and pawl to positions in which said pawl engages said tooth.

3. The invention according to claim 1;

wherein said upper jaw, lower jaw and back form an open end; and wherein said pawl extends into said open end and is pivoted by resulting force applied thereto by forcing said wrench against said nut.

4. The invention according to claim 3 further comprising spring means for biasing said cam and pawl to positions in which said pawl engages said tooth.

5. The invention according to claim 1;

wherein said upper jaw, lower jaw and back form an open end; and wherein said release means extends into said open end and releases said lower jaw by the resulting force applied thereto when said wrench is forced against said nut.

6. The invention according to claim 3 further comprising spring means for biasing said lower jaw to said first position.

7. The invention according to claim 1 further comprising spring means for biasing said lower jaw to said first position.

8. An open-end wrench having an open end expandable between first and second positions, said wrench being adapted for turning a nut in one direction when said open end is in said first position and adapted for rotating around said nut when said open end is expanded to said second position, said wrench comprising:

integral means forming a first jaw and back of said open end, said means having a cut therein from said back;

second jaw means having integral first and second portions, said first portion forming a second jaw, said second portion forming a cam sized to fit within said cut, said cam having a tooth along the edge thereof, said cam being pinned within said cut; and pawl means including pin means, said pawl means being at a location pinned by said pin means within said cut so one end of said pawl means engages said tooth when said pawl means is in a first position, said pawl means being rotatable about said pin means to a second position disengaged from said tooth, said pawl means extending into said open end through said back, and being rotatable by a force being applied thereto at the end opposite to said one end.

9. The invention according to claim 8 further comprising spring means for biasing said second jaw means and said pawl means to positions in which said pawl means engages said tooth.

10. The invention according to claim 8 further comprising:

first spring means compressibly positioned between said means forming said first jaw and back and said second jaw means to normally maintain said second jaw means in a position to allow said pawl means to engage said tooth; and second spring means compressibly positioned between said means forming said first jaw and back and said pawl means to normally maintain said pawl means engaged with said tooth.

11. In an open-end wrench with first and second jaws adapted to having opposite sides of a nut juxtapositioned therewith, said wrench having a body with a top surface and a bottom surface to form a back connecting said first and second jaws, the improvement comprising:

an opening between said top and bottom surfaces;

a second jaw member having first and second portions, said first portion having top and bottom surfaces and a surface connecting said top and bottom surfaces to form said second jaw, said second portion having a top and bottom surface pinned in said opening to allow said second jaw member to rotate, and a surface, including a tooth, connecting said top and bottom surfaces of said of said second portion; and a pawl having first and second ends, said pawl being pinned in said opening to rotate between a first position in which said first end engages said tooth and a second position in which said first end is disengaged from said tooth, said second end extending beyond said back so that when said second end is forced against said nut, said pawl rotates from said first position to said second position allowing said lower jaw member to rotate away from said upper jaw as said wrench is moved around said nut.

12. The invention according to claim 11 wherein said improvement further comprises a spring for biasing said pawl towards said first position.

13. The invention according to claim 12 wherein said improvement further comprises a second spring for biasing said second jaw member to a position so that said first end of said pawl can engage said tooth.

14. The invention according to claim 11:

wherein said nut adapted to having opposite sides thereof juxtapositioned with said wrench has opposite sides separated by a given distance; and wherein said tooth is positioned so that when said pawl engages said tooth said second jaw is said given distance away from said first jaw.

15. The invention according to claim 14:

wherein said nut adapted to having opposite sides thereof juxtapositioned with said wrench has opposite junctions between adjacent sides separated by a second given distance; and wherein second jaw member rotates away from said first jaw by an amount so that said first and second jaws are separated by said second given distance.

16. The invention according to claim 15 wherein said improvement further comprises a spring for biasing said pawl towards said first position.

17. The invention according to claim 16 wherein said improvement further comprises a second spring for biasing said second jaw member to a position so that said first end of said pawl can engage said tooth.

18. The invention according to claim 1 wherein said cam includes a second tooth therein for engaging said release means to prevent further pivotal movement of said lower jaw.

19. The invention according to claim 8 wherein said cam includes a second tooth therein for engaging said pawl means when said pawl means is rotated to said second position, said second tooth being positioned on said cam to define the second position to which said wrench expands.

20. The invention according to claim 11:

wherein said second portion of said second jaw member includes a second tooth connecting said top and bottom surfaces; and wherein said first end of said pawl engages said second tooth to limit the amount said second jaw member rotates when said pawl is rotated to said second position.

* * * * *